US006726345B2

(12) United States Patent
Arumugusaamy et al.

(10) Patent No.: US 6,726,345 B2
(45) Date of Patent: Apr. 27, 2004

(54) LUMINAIRE LENS

(75) Inventors: Panchadsaram Arumugusaamy, Granville, OH (US); Gregory J. Subisak, Gahanna, OH (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 10/034,762

(22) Filed: Dec. 27, 2001

(65) Prior Publication Data

US 2003/0058652 A1 Mar. 27, 2003

Related U.S. Application Data

(63) Continuation-in-part of application No. 09/960,110, filed on Sep. 21, 2001, now Pat. No. 6,637,912.

(51) Int. Cl.[7] ..... F21V 7/00; F21V 5/04

(52) U.S. Cl. ..... 362/327; 362/309; 362/338; 362/339

(58) Field of Search ..... 362/327, 307, 362/308, 335, 326, 309, 338, 339

(56) References Cited

U.S. PATENT DOCUMENTS 4,686,412 A * 8/1987 Johnson, Jr. ..... 313/344
5,446,637 A * 8/1995 Cunningham et al. ..... 362/321

* cited by examiner

*Primary Examiner*—Sandra O'Shea
*Assistant Examiner*—Guiyong Lee
(74) *Attorney, Agent, or Firm*—Kenneth E. Darnell

(57) ABSTRACT

An open type luminaire lens including a non-circular reflective lens having a metalized exterior surface and a prism section, the non-circular reflective lens having a shape generally defined by the combination of two parabolas, the prism section including and array of external reflecting prisms of varying predetermined shapes and varying predetermined sizes for use in providing a desired efficient light distribution.

19 Claims, 5 Drawing Sheets

LUMINAIRE LENS

This is a continuation-in-part application of U.S. Ser No. 09/960,110 filed Sep. 21, 2001 now U.S. Pat. No. 6,637,912.

TECHNICAL FIELD

This invention relates to a luminaire lens which is particularly suited for outdoor lighting such as roadway or street illumination applications as well as general industrial, commercial and sport facility applications.

BACKGROUND ART

Outdoor illumination is needed in many various areas such as suburban roadways, parking lots, inner city parks, toll plazas, airports, industrial facilities, sensitive or secure locations and seaports. The goal is to illuminate these areas so that persons may easily function when natural light is low or unavailable. Outdoor luminaries typically provide this desired function as they are normally positioned above the ground and affixed to buildings, poles, masts or other means of support. Those skilled in the art recognize that a balance must be achieved in several areas. Namely, the luminaire should permit easy access for repair and replacement of internal components when necessary, withstand varying weather conditions, provide an aesthetically pleasing appearance and most importantly provide a desired light distribution.

Outdoor luminaries typically include a housing or base and an optical assembly. The housing is usually exposed to the environment and encloses the electrical circuitry which may include the ballast system. The optical assembly contains a lamp which produces the light and a reflector which directs the light in various directions.

Enclosed luminaries are capable of different light distributions such as symmetrical and asymmetrical. These light distributions are well suited for roadway, parking and area applications. However, to obtain certain light distributions such as long and narrow for use in divided narrow and wide roadways with median mounted applications, asymmetric long and narrow for narrow roadway application with one to four roadway lanes and wide asymmetric for wider roadways, different metal reflectors using different shapes must be used. Specifically circular shapes are capable of producing symmetrical distributions. Metal reflectors are sometimes used with enclosed luminaires. The metal reflectors must be enclosed to prevent decay of the optical finish.

Open type luminaries provide a high efficiency and are typically 9% to 14% more efficient than enclosed or sealed type systems. By definition enclosing the lower portion of the luminaire decreases efficiency as the lower enclosure blocks or diffuses a portion of the exiting light. Outdoor open type luminaires make use of reflectors for directing the light into the proper distribution. Open type luminaires are thus desirable in certain applications such as roadways and parking where a light distribution producing wide spacing is required.

An improved luminaire lens should provide varying types of light distribution through the use of one luminaire lens shape. Savings in manufacturing costs, tooling, advertising and other areas due to the uniform shape are highly desirable. The improved luminaire lens should provide varying types of light distribution using variations in the prismatics of the lens while keeping the overall shape of the lens consistent. The improved luminaire should be able to produce long and narrow, asymmetric long and narrow and wide asymmetric light distributions.

SUMMARY OF INVENTION

It is a principal object of the present invention to provide a outdoor open type luminaire lens having a substantially elliptical shape.

It is a further object of the present invention to provide a outdoor open type luminaire lens having a substantially elliptical shape capable of producing a high efficient light distribution for roadway applications.

It is still a further object of the present invention to provide a outdoor open type luminaire lens having a substantially elliptical shape capable of producing different light distributions by utilizing different reflecting prisms arrangements.

It is a further object of the present invention to provide an outdoor open type luminaire lens, an elliptical reflective lens having a metalized exterior surface and a prism section covering at least twenty-five percent (25%) of the elliptical reflective lens, the prism section including an array of external reflecting prisms of varying predetermined shapes and varying predetermined sizes whereby a desired efficient light distribution is produced.

In a preferred embodiment the open type luminaire lens is manufactured from glass and includes a metalized surface which is comprised of an aluminum coating.

In another preferred embodiment the open type luminaire lens is manufactured from glass and includes a metalized surface which is comprised of a silver coating.

It is yet another object of the present invention to provide an open type luminaire lens including a non-circular reflective lens having a metalized exterior surface and a prism section, the non-circular reflective lens having a shape generally defined by the combination of two parabolas, the prism section including an array of external reflecting prisms of varying predetermined shapes and varying predetermined sizes.

It is still a further object of the present invention to provide an open type luminaire lens system for maximizing light distribution while using a consistently shapes lens.

It is yet another object of the present invention to provide an open type luminaire lens including a non-circular reflective lens having a metalized exterior surface and a prism section, the non-circular reflective lens having a shape generally defined by the combination of two parabolas and the lens also including a diffuse material insert for specific applications for use in changing the light distribution of the lens.

It is yet a further object of the present invention to provide a system for maximizing light distribution including an open type reflective luminaire lens having a generally elliptical shape, the luminaire lens having a metalized exterior surface, an external prism section disposed on the luminaire lens having external reflecting prisms of varying predetermined sizes and varying predetermined shapes whereby desired light distributions of different types can be produced by changing the sizes and shapes of the external reflecting prisms whereby the shape of the open type reflective luminaire lens is defined by the general equation $$x^2/a^2+y^2/b^2=1$$

with z=being 0.0 to 11.0 inches high. In this equation, "a" is in a range from 3.0 to 12.0 inches and "b" is in a range from 3.0 to 12.0 inches at various depths.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
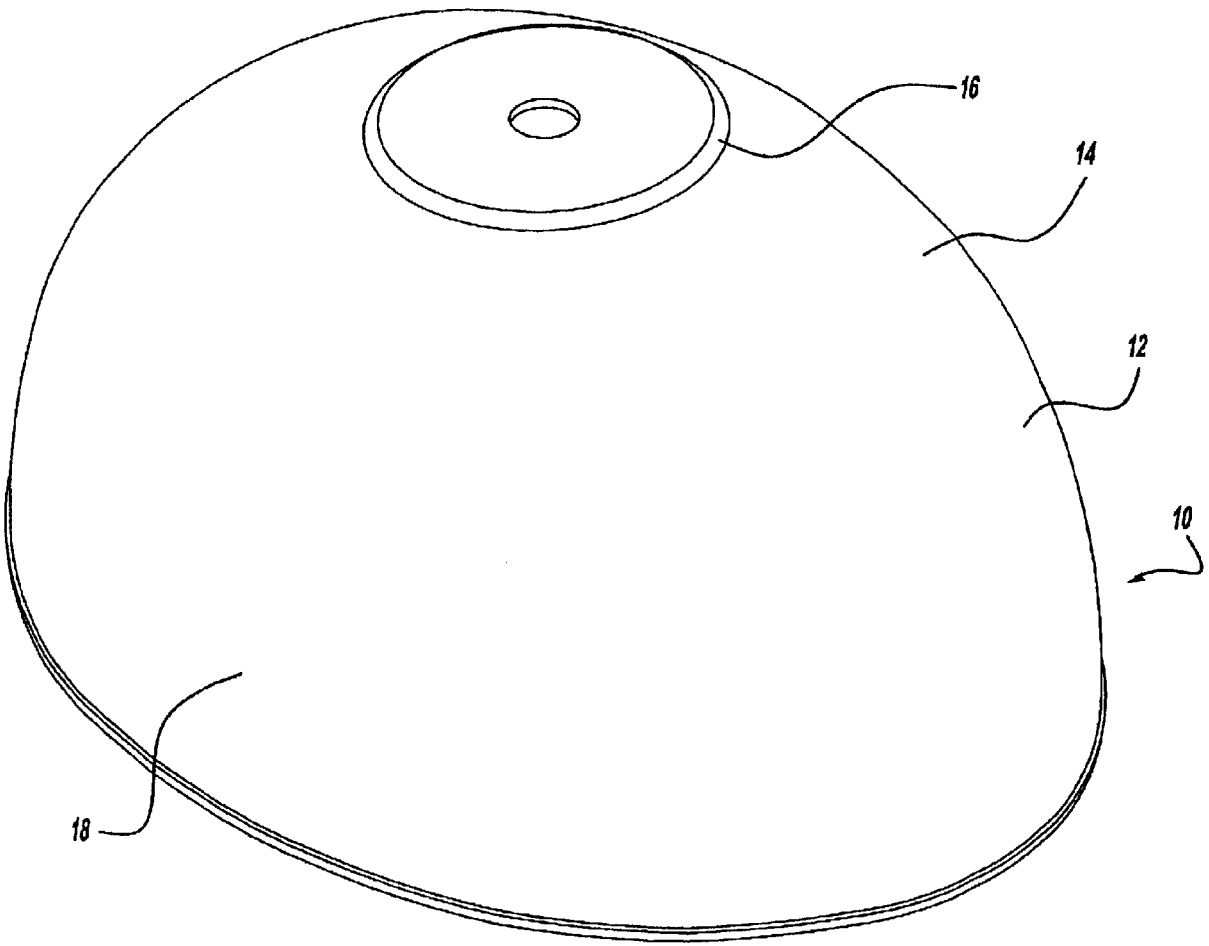
FIG. 1 is a perspective view of a luminaire lens according to the present invention.

With reference to FIG. 1 of the drawings, shown therein is an open type luminaire 10 having a non-circular or elliptical reflective lens 12. Elliptical reflective lens 12 includes and an outer section 14. Elliptical reflective lens 12 has a connector rim 16 for use in connecting the elliptical reflective lens to the housing (not shown). The outer section 14 of the elliptical reflective lens 12 has a metalized exterior surface 18. Metalized exterior surface 18 is, in the preferred embodiment, an aluminum coating in a range from 0.000004 to 0.10 inches deposited directly on the outer section 14 of the elliptical reflective lens. The aluminum coating in the preferred embodiment is a 99.9% pure aluminum alloy containing a combination of aluminum and other metals. Other metallic or plastic coatings are also contemplated by the present invention as well as aluminum primers.

The aluminum coating of the present invention provides a reflective surface for use in directing the light within the luminaire in the desired directions to produce the desired light distributions. In another embodiment, the metalized surface 18 is a silver coating of 0.004 to 10.0 thousandths of an inch deposited directly on the outer section 14 of the elliptical reflective lens. The silver coating is in this embodiment is an pure alloy containing a combination of silver and other metals. Other coatings such as a specular reflective polymer or diffuse reflective polymer or preprocessed reflective film may also be used.

Figure 2:
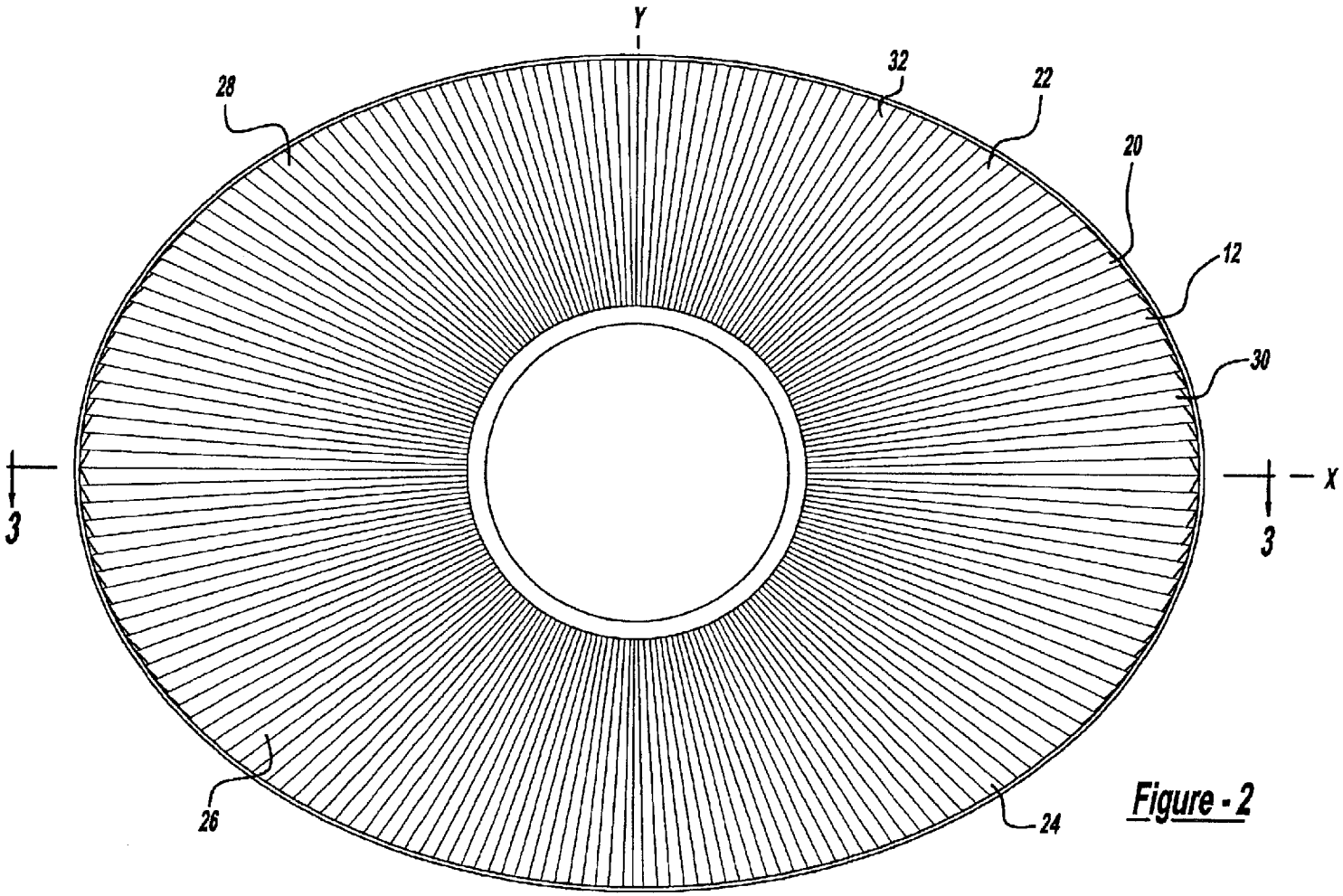
FIG. 2 is a bottom view of the luminaire lens of the present invention.

Referring now to FIG. 2, there is shown the elliptical reflective lens 12. The elliptical reflective lens 12 is made of a boro-silicate glass in the preferred embodiment. It may also made of a clear plastic such as an acrylic resin. In this embodiment, the acrylic resin would be a clear acrylic plastic. The elliptical reflective lens 12 may have a general thickness in a range from 0.1875 to 0.50 inches.

Elliptical reflective lens 12 includes a prism section 20. Prism section 20 should be located on at least twenty five percent (25%) of the elliptical reflective lens. In the preferred embodiment, the prism section is disposed on substantially all of the elliptical reflective lens as shown in FIG. 2. In the preferred embodiment, the elliptical reflective lens 12 has a prism section 20 made of four quadrants 22, 24, 26 and 28. Each quadrant has a predefined number of prisms 30. The quadrants are defined between the X and Y axis as shown in FIG. 2.

In the preferred embodiment, for providing a light distribution of long and narrow each quadrant has an array 32 of thirty nine separate prisms 30. It is contemplated by the present invention that arrays 32 or arrangements of prisms 30 may include more or less that thirty nine separate prisms. Prism numbers will depend on the overall size and light distribution requites of the luminaire desired. Each prism 30 within the quadrant has a different shape and size depending on its location within the quadrant. Each prism 30 is a reflective prism. The prism array 32 is defined by the relationship of certain angles and widths of the specific prisms 30

Figure 5:
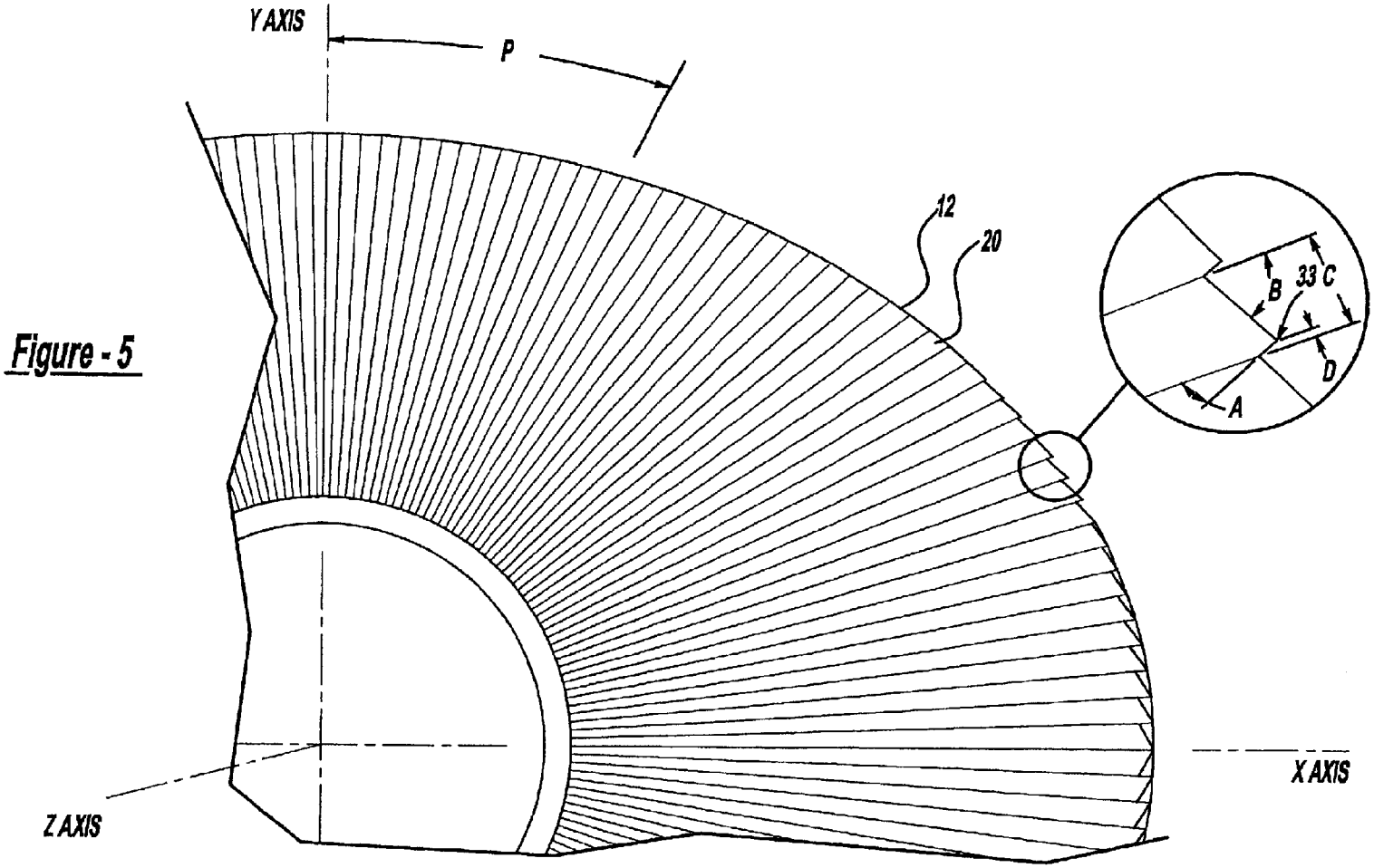
FIG. 5 illustrates the angles defined by the individual prisms disposed on the lens of the present invention.

More specifically, as shown in FIG. 5, each prism has an angle A, angle B, angle C and angle D. Angle A is defined by a counter clockwise angle from the leading point of the prism to the convergence point 33 of this and the adjoining prisms. Angle B is defined by a clockwise angle from the leading point of the prism to the convergence point 33 of this and the adjoining prisms. Angle C is the angle between the convergence point 33 of the prism 30 and the beginning of the prism 30 at point 36. Angle D is the angle between the convergence point 33 and leading point of this prism. In reaching the desired light distribution of long and narrow described above, angle A, angle B, with the location angle P have the following relationship. The location angle P starts along minor axis (y=0) and has a value of 90 degrees along the major axis x=0, angles A, B and P are in degrees as shown in FIG. 5.

Angle $A=P+8$; for values $0 \leqq P \leqq 9$; and

Angle $A=21.305\mathrm{Ln}(P)-41.714$; for values of $10 \leqq P \leqq 44$ degrees; and Angle $A=(-0.0078)P^2+0.9513P-4.6875$; for values $46 \leqq P \leqq 90$ degrees Angle $B=0.0049P^2-0.7615P+91.437$; for $0 \leqq P \leqq 44$ degrees; and Angle $B=0.0075P^2-0.9243P+93.869$; for values $46 \leqq P \leqq 88$ degrees.

Angle $B=P-20$; for values $89 \leqq P \leqq 90$ degrees.

It is understood that this relationship is defined only for the light distribution of long and narrow or long and wide and as different distributions are required, different relationships are necessary.

Quadrant 22 has a certain array 32 or arrangement of prisms as defined above. Quadrant 24, located adjacent quadrant 22 has an array 32 or arrangement of prisms 30 which is the mirror image of quadrant 22. Similarly, as shown in FIG. 2, quadrants 26 and 28 are the mirror image of quadrants 22 and 24. In this manner, a consistent arrangement of the prisms 30 is provided.

Figure 3:
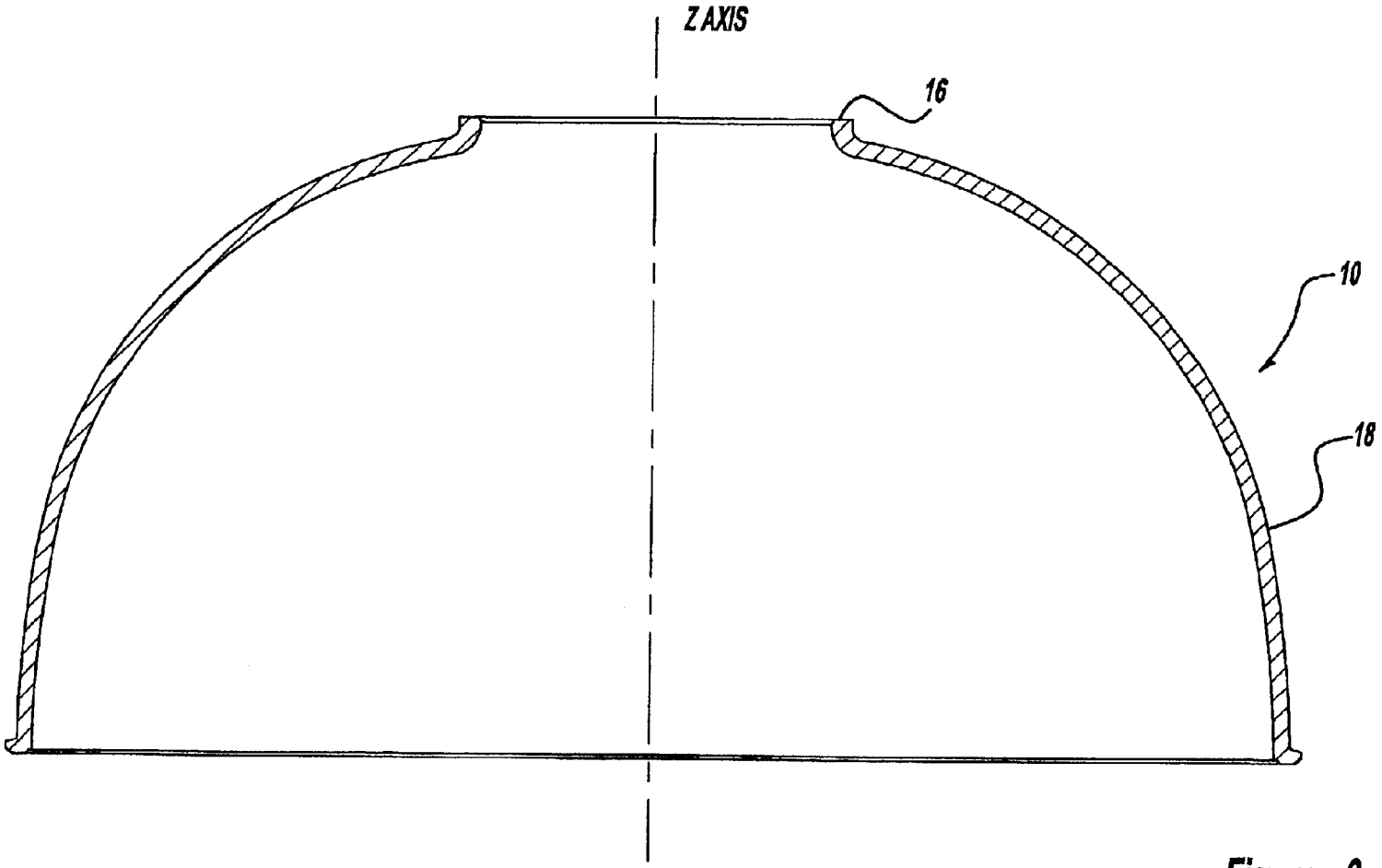
FIG. 3 is a cross section of the luminaire lens of the present invention taken along lines 3—3 of FIG. 2.

Referring now to FIG. 3, the elliptical reflective lens has a non-circular shape. This shape is specific to the present invention and is defined by the combination of two parabolas. This combination of parabolas forms the elliptical or non-circular shape and is unique to the present invention as open type luminaires are circular or square in shape. The elliptical reflective lens 12 has been found to maximize the light leaving the luminaire 10 in an open optic type prismatic process. In combination with the array 32 of prisms 30, the elliptical shape produces a highly efficient light distribution of long and narrow which is especially well suited for roadway applications.

Figure 4:
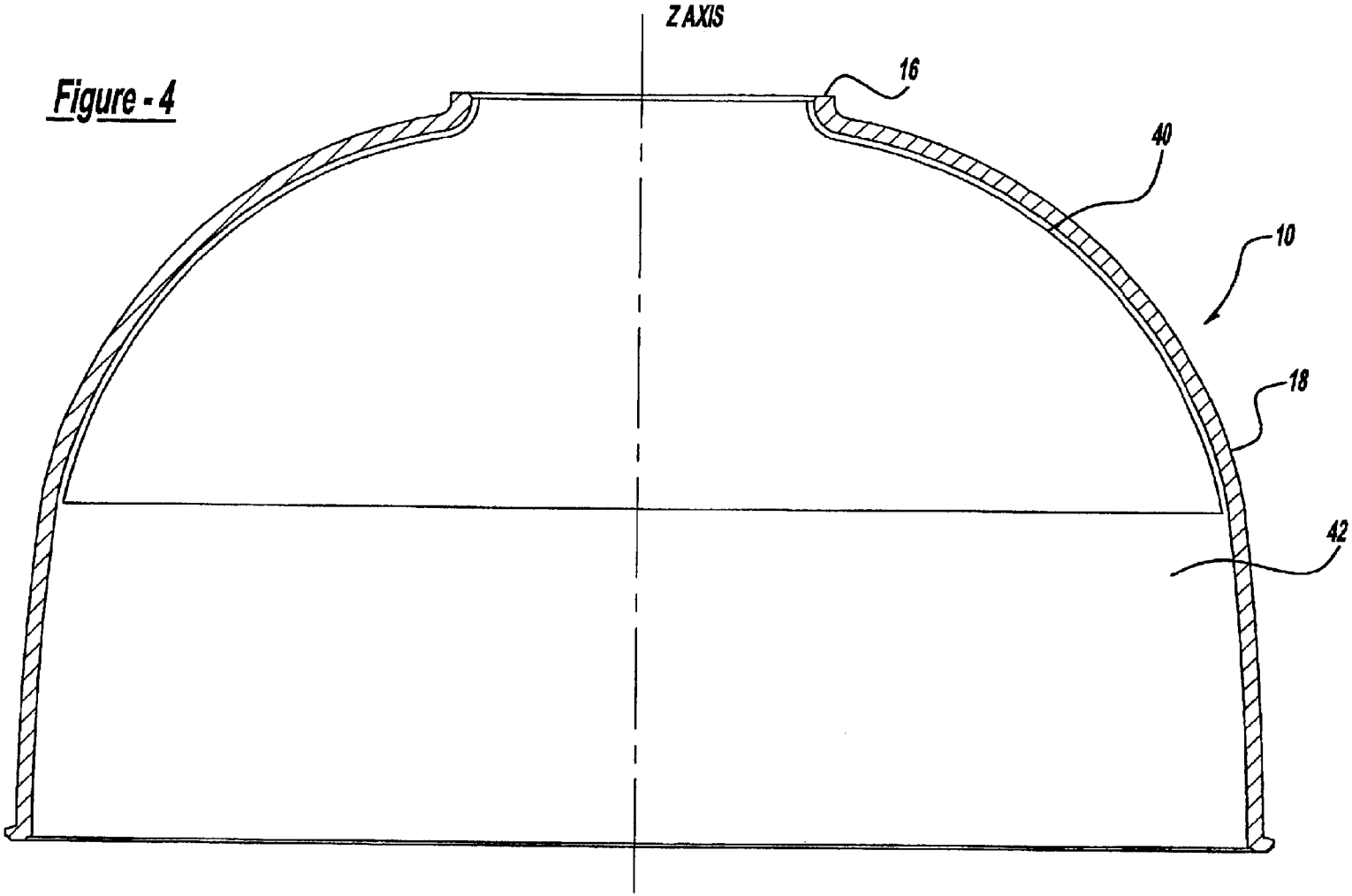
FIG. 4 is a cross section of the luminaire lens of the present invention showing a diffuse material insert located within the luminaire lens.

FIG. 4 illustrates an alternative embodiment of the present invention. A diffuse material insert 40 is disposed within the inside area 42 of the lens 12. As shown, the shape of the diffuse material insert 40 is designed to correspond or mate with the shape of the shape of the lens 12. The diffuse material insert 42 provides a diffusion light which allows a different resulting distribution of the light from the lens 12. In the preferred embodiment of the present invention, the diffuse material insert 42 will made from aluminum. The diffuse material insert 42 may also be made from plastic or polymer type materials which diffuse light rays. Different materials will provide different light distributions. In the preferred embodiment, where the diffuse material insert 42 is made of aluminum, the insert 42 provides a distinctive light distribution pattern of long narrow.

While the best mode for carrying out the invention has been described in detail, those familiar with the art to which this invention relates will recognize various alternative designs and embodiments for practicing the invention as defined by the following claims.

What is claimed is:

1. An open type luminaire lens comprising:

a non-circular reflective lens having a metalized exterior surface and a prism section, said non-circular reflective lens having a shape generally defined by the combination of two parabolas, said prism section an array of external reflecting prisms of varying predetermined shapes and varying predetermined sizes, said predetermined shapes and predetermined sizes defined by the relationship of angles A, B and P where angle A is defined by a counter clockwise angle from the leading point of a first prism to the convergence point of said first prism and a next adjoining prism, angle B is defined by a clockwise angle from the leading point of said first prism to the convergence point of said first prism and said next adjoining prism and angle P is starts along minor axis (y=0) and has a value of 90 degrees along the major axis x=0 with angle A, angle B and angle P having the following relationship:

Angle $A=P+8$; for values $0 \leqq P \leqq 9$; and

Angle $A=21.305Ln(P)-41.714$; for values of $10 \leqq P \leqq 44$ degrees; and

Angle $A=(-0.0078)P^2+0.9513P-4.6875$; for values $46 \leqq P \leqq 90$ degrees

Angle $B=0.0049P^2-0.7615P+91.437$; for $0 \leqq P \leqq 44$ degrees; and

Angle $B=0.0075P^2-0.9243P+93.869$; for values $46 \leqq P \leqq 88$ degrees;

Angle $B=P-20$; for values $89 \leqq P \leqq 90$ degrees.

2. The open type luminaire lens of claim 1 wherein said elliptical reflective lens is manufactured from glass and said metalized surface is comprised of an aluminum coating.

3. The open type luminaire lens of claim 1 wherein said elliptical reflective lens is manufactured from glass and said metalized surface is comprised of a silver coating.

4. The open type luminaire lens of claim 1 wherein said elliptical reflective lens is manufactured from plastic and said metalized surface is comprised of an aluminum coating.

5. The open type luminaire lens of claim 1 wherein said elliptical reflective lens is manufactured from plastic and said metalized surface is comprised of a silver coating.

6. The open type luminaire lens of claim 1 further including a diffuse material insert.

7. An open type luminaire lens system for maximizing light distribution comprising:

an open type reflective luminaire lens having a generally elliptical shape, said luminaire lens having a metalized exterior surface;

an external prism section disposed on said luminaire lens having external reflecting prisms of varying predetermined sizes and varying predetermined shapes whereby desired light distributions of different types can be produced by changing the sizes and shapes of said external reflecting prisms whereby the shape of the open type reflective luminaire lens is defined by the surface envelope general equation $$x^2/a^2+y^2/b^2=1$$

with z= being in a range from 0.0 to 11.0, a in a range from 3.0 to 12.0 and b in a range from 3.0 to 12.0.

8. The open type luminaire lens system of claim 7 wherein said elliptical reflective lens is manufactured from glass and said metalized surface is comprised of an aluminum coating.

9. The open type luminaire lens system of claim 7 wherein said elliptical reflective lens is manufactured from glass and said metalized surface is comprised of a silver coating.

10. The open type luminaire lens system of claim 7 wherein said elliptical reflective lens is manufactured from plastic and said metalized surface is comprised of an aluminum coating.

11. The open type luminaire lens system of claim 7 wherein said elliptical reflective lens is manufactured from plastic and said metalized surface is comprised of a silver coating.

12. The open type luminaire lens system of claim 7 further including a diffuse material insert.

13. The open type luminaire lens system of claim 7 whereby said predetermined shapes and predetermined sizes of said prisms are defined by the relationship of angles A, B and P where angle A is defined by a counter clockwise angle from the leading point of a first prism to the convergence point of said first prism and a next adjoining prism, angle B is defined by a clockwise angle from the leading point of said first prism to the convergence point of said first prism and said next adjoining prism and angle P is starts along minor axis (y=0) and has a value of 90 degrees along the major axis x=0 with angle A, angle B and angle P having the following relationship:

Angle $A=P+8$; for values $0 \leqq P \leqq 9$; and

Angle $A=21.305Ln(P)-41.714$; for values of $10 \leqq P \leqq 44$ degrees; and

Angle $A=(-0.0078)P^2+0.9513P-4.6875$; for values $46 \leqq P \leqq 90$ degrees

Angle $B=0.0049P^2-0.7615P+91.437$; for $0 \leqq P \leqq 44$ degrees; and

Angle $B=0.0075P^2-0.9243P+93.869$; for values $46 \leqq P \leqq 88$ degrees;

Angle $B=P-20$; for values $89 \leqq P \leqq 90$ degrees.

14. An open type luminaire lens, comprising:

an elliptical reflective lens having a metalized exterior surface and a prism section covering at least twenty-five percent of said elliptical reflective lens, said prism section including an way of external reflecting prisms of varying predetermined shapes and varying predetermined sizes whereby a desired efficient light distribution is produced, the lens further including a diffuse material insert.

15. The open type luminaire lens of claim 14 wherein said elliptical reflective lens is manufactured from glass and said metalized surface is comprised of an aluminum coating.

16. The open type luminaire lens of claim 14 wherein said elliptical reflective lens is manufactured from glass and said metalized surface is comprised of a silver coating.

17. The open type luminaire lens of claim 14 wherein said elliptical reflective lens is manufactured from plastic and said metalized surface is comprised of an aluminum coating.

18. The open type luminaire lens of claim 14 wherein said elliptical reflective lens is manufactured from plastic and said metalized surface is comprised of a silver coating.

19. The open type luminaire lens of claim 14 wherein said prism section covers substantially all of said elliptical reflective lens.

* * * * *